US007188464B2

(12) United States Patent
Ackerman et al.

(10) Patent No.: US 7,188,464 B2
(45) Date of Patent: Mar. 13, 2007

(54) METHODS FOR OPERATING GAS TURBINE ENGINES

(75) Inventors: John Frederick Ackerman, Laramie, WY (US); William Kent Wagner, Somerville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/072,084

(22) Filed: Mar. 4, 2005

(65) Prior Publication Data

US 2005/0144957 A1 Jul. 7, 2005

Related U.S. Application Data

(62) Division of application No. 10/188,460, filed on Jul. 3, 2002, now Pat. No. 6,920,748.

(51) Int. Cl.
*B64D 15/08* (2006.01)

(52) U.S. Cl. ..... 60/39.093; 244/134 C

(58) Field of Classification Search ..... 60/39.093; 244/134 R, 134 B, 134 C, 134 E
See application file for complete search history.

(56) References Cited

U.S. PATENT DOCUMENTS 2,075,658 A * 3/1937 Ramsbottom et al. .. 244/134 C
2,075,659 A * 3/1937 Ramsbottom et al. .. 244/134 C
2,098,566 A * 11/1937 Chilton ..... 244/134 C
2,390,093 A * 12/1945 Garrison ..... 244/134 C
2,457,031 A * 12/1948 Campbell et al. ..... 244/134 C
3,423,052 A * 1/1969 Lear ..... 244/134 C
3,614,038 A * 10/1971 Nichols ..... 244/134 C
4,434,201 A * 2/1984 Humphreys ..... 244/134 C
5,088,277 A 2/1992 Schulze
5,944,287 A * 8/1999 Rodgers ..... 60/39.093
6,279,856 B1 8/2001 Rutherford et al.
6,330,986 B1 12/2001 Rutherford et al.
6,510,684 B2 1/2003 Matsunaga
6,920,748 B2 7/2005 Ackerman et al.
6,990,797 B2 1/2006 Venkataramani et al.

FOREIGN PATENT DOCUMENTS

EP 0599502 * 6/1994
GB 2130158 * 5/1984

* cited by examiner

*Primary Examiner*—Michael Koczo, Jr.
(74) *Attorney, Agent, or Firm*—William Scott Andes; Armstrong Teasdale LLP

(57) ABSTRACT

A method for operating an aircraft engine facilitates preventing ice accumulation on the aircraft engine. The method comprises coupling a semi-permeable membrane to the engine adjacent an outer surface of the engine, coupling a fluid reservoir to the aircraft engine in flow communication with the semi-permeable membrane, and supplying fluid from the fluid reservoir to the semi-permeable membrane to facilitate preventing ice accumulation on the aircraft engine outer surface.

3 Claims, 2 Drawing Sheets

METHODS FOR OPERATING GAS TURBINE ENGINES

CROSS REFERENCE TO RELATED APPLICATIONS

This application is a divisional of U.S. application Ser. No. 10/188,460 filed Jul. 3, 2002, now an issued patent, U.S. Pat. No. 6,920,748, which is hereby incorporated by reference.

BACKGROUND OF THE INVENTION

This invention relates generally to gas turbine engines, and more particularly, to methods and apparatus for operating gas turbine engines.

Gas turbine engines typically include high and low pressure compressors, a combustor, and at least one turbine. The compressors compress air which is mixed with fuel and channeled to the combustor. The mixture is then ignited for generating hot combustion gases, and the combustion gases are channeled to the turbine which extracts energy from the combustion gases for powering the compressor, as well as producing useful work to propel an aircraft in flight or to power a load, such as an electrical generator.

When engines operate in icing conditions, ice may accumulate on exposed external engine structures. More specifically, if engines are operated within icing conditions at low power for extended periods of time, ice accumulation within the engine and over the exposed engine structures may be significant. Over time, continued operation of the engine, or a throttle burst from lower power operations to higher power operations, may cause the accumulated ice build-up to be ingested by the high pressure compressor. Such a condition, known as an ice shed, may cause the compressor discharge temperature to be suddenly reduced. In response to the sudden decrease in compressor discharge temperature, the corrected core speed increases in the aft stages of the high pressure compressor. This sudden increase in aft stage corrected core speed may adversely impact compressor stall margin.

To facilitate preventing ice accumulation within the engine and over exposed surfaces adjacent the engine, at least some known engines include a control system that enables the engine to operate with an increased operating temperature and may include sub-systems that direct high temperature bleed air from the engine compressor to the exposed surfaces. However, the increased operating temperature and the bleed systems may decrease engine performance. As such, to further facilitate preventing ice accumulation at least some known engines are sprayed with a deicing solution prior to operation. However, during flight and over time, the effectiveness of the deicing solution may decrease. More specifically, during engine operation, evaporative cooling may still cause freezing and ice accumulation over external engine surfaces, such as a front frame of the engine.

BRIEF SUMMARY OF THE INVENTION

In one aspect of the invention, a method for operating an aircraft engine to facilitate preventing ice accumulation on the aircraft engine is provided. The method comprises coupling a membrane to the engine adjacent an outer surface of the engine, coupling a fluid reservoir to the aircraft engine in flow communication with the membrane, and supplying fluid from the fluid reservoir to the membrane to facilitate preventing ice accumulation on the aircraft engine outer surface.

In another aspect, an ice protection system for an aircraft engine including a front frame is provided. The ice protection system is coupled to the aircraft engine and includes semi-permeable membrane and a fluid reservoir. The semi-permeable membrane is in flow communication with the fluid reservoir to facilitate preventing ice formation on the engine front frame.

In a further aspect of the invention, an aircraft ice protection system is provided. The system is coupled to the aircraft and includes at least one of a semi-permeable membrane and a microporous membrane, and a fluid reservoir coupled in flow communication. The fluid reservoir supplies fluid to at least one of the semi-permeable member and the microporous membrane to facilitate preventing ice formation on an external surface of the aircraft engine.

DETAILED DESCRIPTION OF THE INVENTION

Figure 1:
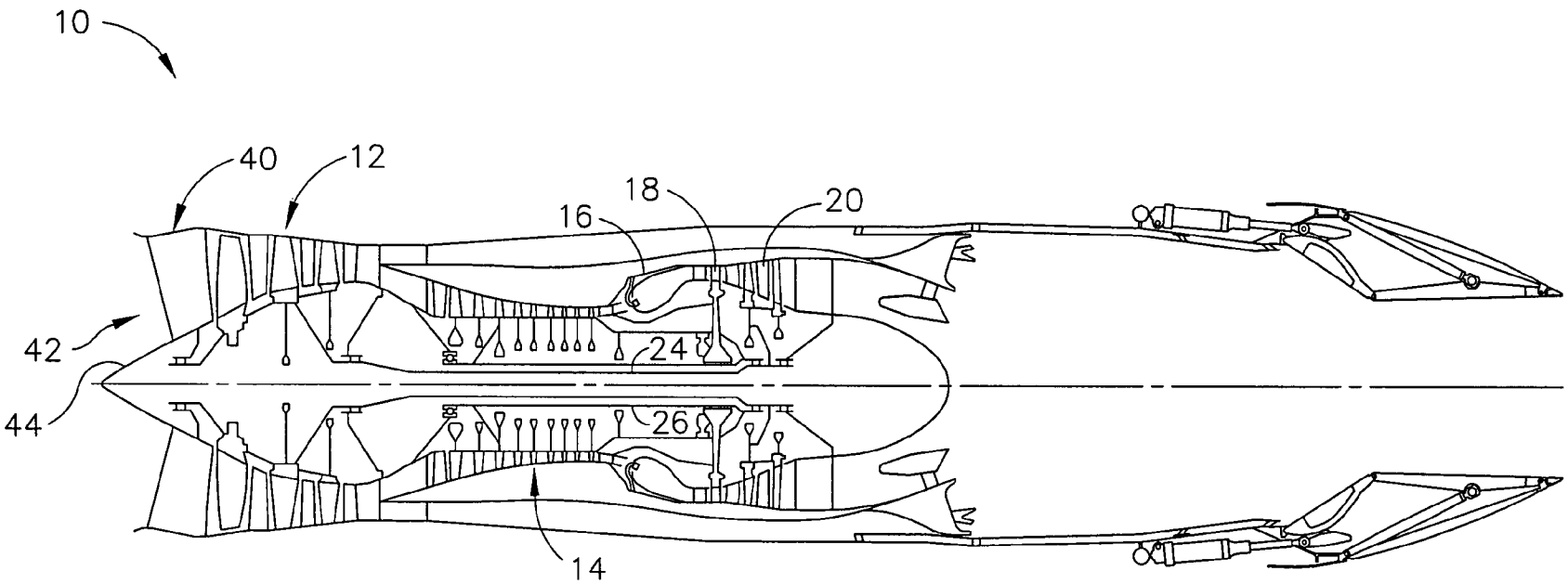
FIG. 1 is schematic illustration of a gas turbine engine.

FIG. 1 is a schematic illustration of a gas turbine engine 10 including a fan assembly 12, a high pressure compressor 14, and a combustor 16. In one embodiment, engine 10 is an F110 engine commercially available from General Electric Company, Cincinnati, Ohio. Engine 10 also includes a high pressure turbine 18 and a low pressure turbine 20, all arranged in a serial, axial flow relationship. Fan assembly 12 and turbine 20 are coupled by a first shaft 24, and compressor 14 and turbine 18 are coupled by a second shaft 26.

Engine 10 also includes an annular front frame 40 which supports a bearing (not shown) which, in turn, supports one end of a shaft, such as shaft 24, for allowing rotation thereof. A plurality of circumferentially-spaced inlet guide vane assemblies 42 extend between an outer structural case ring (not shown in FIG. 1) and a center hub 44 and direct airflow entering engine 10 downstream to compressor 14.

In operation, air flows through inlet guide vane assemblies 42 and through fan assembly 12, such that compressed air is supplied from fan assembly 12 to high pressure compressor 14. The highly compressed air is delivered to combustor 16. Airflow from combustor 16 drives rotating turbines 18 and 20 and exits gas turbine engine 10. Engine 10 is operable at a range of operating conditions between design operating conditions and off-design operating conditions.

Figure 2:
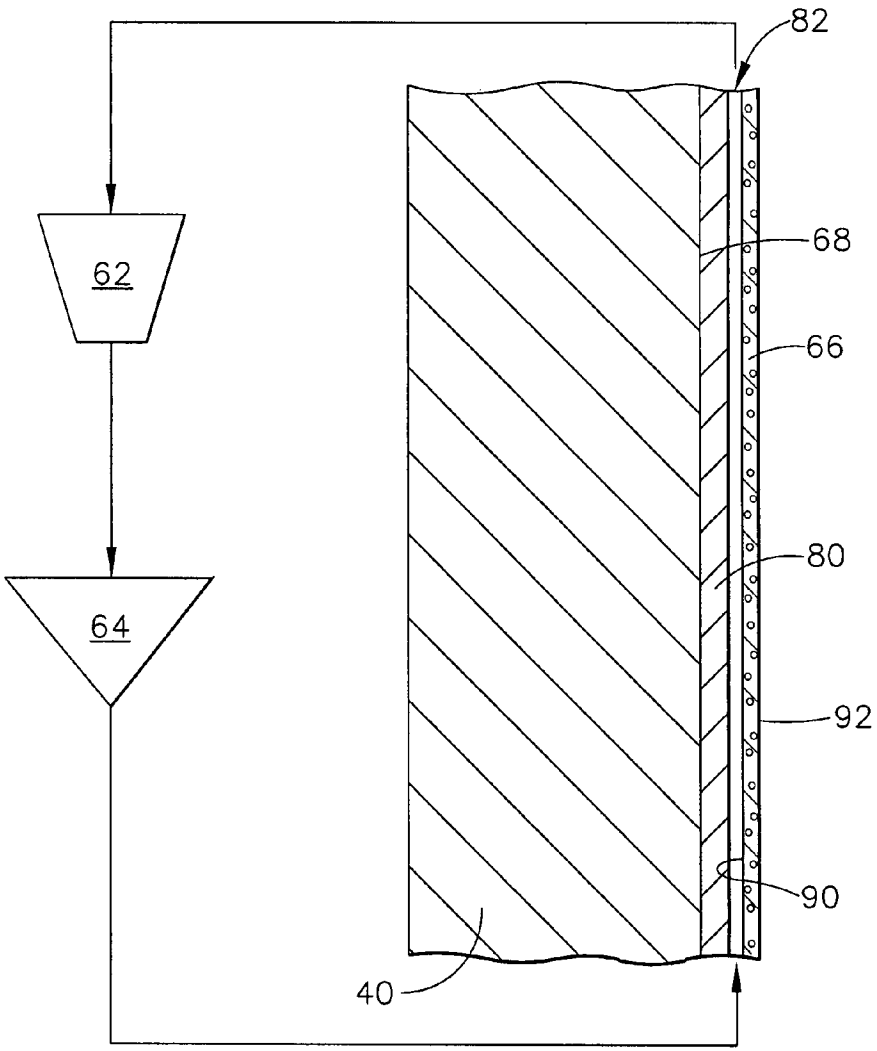
FIG. 2 is a schematic illustration of an ice protection system that may be used with the gas turbine engine shown in FIG. 1.

FIG. 2 is a schematic illustration of an ice protection system 60 that may be used with a gas turbine engine, such as gas turbine engine 10 (shown in FIG. 1). In another embodiment, ice protection system 60 is used to facilitate preventing ice accumulation along exposed surfaces (not shown) of an aircraft (not shown), such as, but not limited to, a control surface (not shown). Ice protection system 60 includes a fluid reservoir 62, a fluid pump 64, and a semi-permeable membrane 66. In an alternative embodiment, ice protection system 60 includes a machined microporous membrane rather than semi-permeable membrane 66. Specifically, semi-permeable membrane 66 is coupled to an external surface 68 to facilitate preventing ice accumulation along exposed surfaces such as surface 68. In the exemplary embodiment, semi-permeable membrane 66 is coupled to a leading edge surface 68 of engine front frame 40 to facilitate preventing ice accumulation against front frame 40. More specifically, semi-permeable membrane 66 is coupled to a distributor or spacer 80 that is coupled to surface 68. Spacer 80 ensures that a flowpath gap 82 is defined between semi-permeable membrane 66 and surface 68.

Pump 64 and reservoir 62 are coupled in flow communication with each other and with membrane 66 and gap 82, such that system 60 forms a pseudo-closed loop system formed with gap 82 and membrane 66. More specifically, because membrane 66 is semi-permeable, a portion of fluid circulating through system 60 passes through membrane 66 in a wicking process, described in more detail below, and the remaining fluid is recirculated through system 60. In one embodiment, ice protection system 60 is coupled to a processor-based engine control system. The term processor, as used herein, refers to microprocessors, application specific integrated circuits (ASIC), logic circuits, and any other circuit or processor capable of executing system 60 as described herein.

During operation, fluid is supplied from reservoir 62 by pump 64 to gap 82. The fluid facilitates preventing ice accumulation on surface 68. In one embodiment, the fluid is a glycol or alcohol mixture which combines with water, in a liquid or solid state, that is that is exposed to either surface 68 or an membrane 66. For example, such a fluid mixture may reduce a freezing point temperature as low as −50° F. More specifically, the fluid is supplied to gap 82 by pump 64 and a portion of the fluid is dispersed from an internal surface 90 of membrane 66 to an external surface 92 of membrane 66. In one embodiment, fluid dispersed onto surface 92, in a process known as freezing point depression, facilitates reducing a freezing point of water in contact with surface 92 to facilitate preventing ice accumulation against surface 68.

In another embodiment, the fluid dispersion onto surface 92 facilitates reducing a viscosity of surface 68 to facilitate preventing ice accumulation against surface 68. In one embodiment, a hydrocarbon oil fluid mixture is circulated within system 60 to facilitate reducing surface viscosity. Thus, system 60 facilitates enhanced compressor stall margin when the engine is operating in potential icing conditions, and thus facilitates preventing compressor ice shed events. Accordingly, system 60 also facilitates preventing engine 10 from surging following an ice shed ingestion. Furthermore, because the fluid circulating within system 60 is not required to be at an elevated operating temperature, a variety of materials may be used in fabricating system 60.

The above-described ice protection system is cost-effective and highly reliable in facilitating the prevention of ice accumulation along exposed surfaces. Fluid supplied through the system is dispersed through a semi-permeable membrane in a wicking process in a cost-effective manner. Accordingly, because bleed air is not utilized, the ice protection system facilitates preventing ice accumulation without sacrificing engine performance or without requiring expensive inflatable bladders. As a result, the ice control system facilitates enhanced compressor stall margin when the engine is operating in potential icing conditions, and thus eliminates compressor stall margin shortfalls that may occur following a compressor ice shed event, or when a reduced fuel schedule is used with the engine.

While the invention has been described in terms of various specific embodiments, those skilled in the art will recognize that the invention can be practiced with modification within the spirit and scope of the claims.

What is claimed is:

1. A method for operating an aircraft engine to facilitate preventing ice accumulation on the aircraft engine, said method comprising:

coupling a membrane to the engine adjacent an outer surface of the engine;

coupling a spacer to the engine between the outer surface of the engine and the membrane includes positioning the spacer against the outer surface of the engine and coupling the spacer to the membrane such that a gap is defined between the membrane and the spacer;

coupling a fluid reservoir to the aircraft engine in flow communication with the membrane; and supplying fluid from the fluid reservoir to the membrane to facilitate preventing ice accumulation on the aircraft engine outer surface.

2. A method in accordance with claim 1 wherein supplying fluid from the fluid reservoir further comprises supplying fluid through the gap to the membrane.

3. A method in accordance with claim 1 wherein supplying fluid from the fluid reservoir to the membrane further comprises supplying fluid to the membrane to facilitate reducing a freezing point for ice accumulation along the engine outer surface, wherein the membrane is a semi-permeable membrane.

* * * * *